US005516303A

United States Patent [19]

Yohn et al.

[11] Patent Number: 5,516,303

[45] Date of Patent: May 14, 1996

[54] FLOATING PANEL-MOUNTED COAXIAL CONNECTOR FOR USE WITH STRIPLINE CIRCUIT BOARDS

[75] Inventors: Brent D. Yohn, Newport; Robert C. Hosler, Sr., Marysville, both of Pa.

[73] Assignee: The Whitaker Corporation, Wilmington, Del.

[21] Appl. No.: 371,189

[22] Filed: Jan. 11, 1995

[51] Int. Cl.[6] ..... H01R 13/629

[52] U.S. Cl. ..... 439/248

[58] Field of Search ..... 439/246–248, 439/252

[56] References Cited

U.S. PATENT DOCUMENTS

| | | | |
|---|---|---|---|
| 2,540,012 | 1/1951 | Salati | 178/44 |
| 3,323,083 | 5/1967 | Ziegler, Jr. | 333/97 |
| 3,325,752 | 6/1967 | Barker | 333/34 |
| 3,350,666 | 10/1967 | Ziegler, Jr. | 333/33 |
| 3,437,960 | 4/1969 | Ziegler, Jr. | 333/97 |
| 3,439,294 | 4/1969 | Flanagan et al. | 333/33 |
| 3,469m972 | 8/1969 | Ziegler, Jr. | 333/33 |
| 3,492,605 | 1/1970 | Ziegler, Jr. | 333/33 |
| 3,559,112 | 1/1971 | Ziegler, Jr. | 333/33 |
| 3,566,334 | 2/1971 | Ziegler, Jr. | 339/64 |
| 4,227,765 | 10/1980 | Neumann et al. | 339/143 R |
| 4,580,862 | 4/1986 | Johnson | 439/248 |
| 4,697,859 | 10/1987 | Fisher, Jr. | 439/246 |
| 4,708,666 | 11/1987 | Fisher, Jr. | 439/580 |
| 4,789,351 | 12/1988 | Fisher, Jr. et al. | 439/248 |
| 4,824,399 | 4/1989 | Bogar et al. | 439/578 |
| 4,861,271 | 8/1989 | Bogar et al. | 439/63 |
| 4,917,630 | 4/1990 | Hubbard | 439/578 |
| 5,217,391 | 6/1993 | Fisher, Jr. | 439/578 |
| 5,234,353 | 8/1993 | Scholz et al. | 439/289 |
| 5,329,262 | 7/1994 | Fisher, Jr. | 333/33 |
| 5,395,249 | 3/1995 | Reynolds et al. | 439/65 |

OTHER PUBLICATIONS

AMP Catalog 80–570, "Guide to RF Connectors", pp. 4–13, 103, 106, 107; May 1990; AMP Incorporated, Harrisburg, PA.

Servometer Catalog, "Servometer Gold Plated Bellows Contact Springs", five pages; Servometer, Cedar Grove, NJ.

ASMCO Catalog No.94, 'Cylindrically Curved Washers "Spring Steel", p. 85; (1994) Accurate Screw Machine Co, Fairfield, NJ.

*Primary Examiner*—Gary F. Pauman

*Attorney, Agent, or Firm*—Anton P. Ness

[57] ABSTRACT

A coaxial connector (50) float-mounted in a panel aperture (58) for mating with a mating coaxial connector (10) fixedly mounted in a second panel (12) and spring biased to adapted to a range of axial positions of the mating coaxial connector upon full mating. A subassembly (60) is movably mounted within an outer shell (56) of connector (50) and contains a contact member (68) within a dielectric sleeve (70) all within an intermediate conductive housing (62). An annular spring (94) of minimal axial dimension is disposed between a rearwardly facing abutment surface (100) of the intermediate housing and a flange of the outer shell (56) rearwardly thereof, biasing the subassembly forwardly. Annular spring (94) permits radial movement of subassembly (60) within outer shell (56) to adjust to an offset mating coaxial connector, and also permits incremental axial movement resulting from mating. Coaxial connector (50) is useful to provide a coaxial connection to a stripline circuit board (54) having a resilient contact (116) secured to a signal circuit (110) thereof also permitting limited axial and radial movement resulting from connector mating.

8 Claims, 8 Drawing Sheets

FLOATING PANEL-MOUNTED COAXIAL CONNECTOR FOR USE WITH STRIPLINE CIRCUIT BOARDS

FIELD OF THE INVENTION

The present invention relates to coaxial electrical connectors and more particularly coaxial connectors adapted to be mounted to panels or housings for mating of multiconnector assemblies.

BACKGROUND OF THE INVENTION

Certain apparatus require simultaneous mating of a plurality of connectors including at least one coaxial connector, to complete a plurality of circuits to perform a task. For convenience, first ones of the connectors are all mounted to a common panel (or housing) to be manipulated as a single unit to be mated simultaneously to second connectors also mounted to a common panel (or housing). The panels are moved relatively axially together to accomplish mating of all the connector pairs, and the panels are commonly secured to larger articles that are moved together. Alignment of the panels to each other, and the final positions thereof transversely and axially upon complete panel movement, are controlled as precisely as possible to assure a mated relationship within a very limited tolerance range. By their very nature, coaxial connectors are exceedingly sensitive to the need for being mated consistently to an exact relationship between the signal conductors and the outer conductors of both connector halves upon mating, for optimum signal transmission performance with minimal impedance mismatch. The very limited tolerance range for the mated panels is generally not assuredly exact enough to result in the coaxial connectors becoming mated in their optimum mated condition.

One design of matable coaxial connector assemblies useful in multiconnector mating, is disclosed in U.S. Pat. No. 4,697,859 and generally provides for axial and radial float to achieve generally accurate centering and optimum axial positioning upon mating. A first coaxial connector, or jack, is fixedly mounted in its panel, while the second connector, or plug, is retained within a panel aperture using a split retention ring around its outer shielding shell cooperating with an outwardly flanged bushing affixed to the outer shell to trap therebetween an inwardly directed flange of the aperture at the rearward end of the connector. The retention ring is movable axially along the central portion of the outer shell and is biased against the aperture flange by a compression spring forwardly thereof along the housing central portion. The spring biases the outer shell forwardly, and is compressible rearwardly against the retention ring during connector mating upon abutment of the leading end of the jack against a shoulder of the plug, to achieve a desired axial positioning of the plug and jack connectors compensating for a range of variations in the final spacing of the two panels. Radial alignment results from the plug connector being float mounted within a larger aperture, and adjusting movement results from engagement of the leading end of the jack's outer shielding shell bearing against a tapered leadin surface at the entrance to the plug's outer shell, with the plug reacting to the engagement by moving itself transversely within its panel aperture, thus centering itself with respect to the jack.

In U.S. Pat. No. 4,789,351 a jack connector is affixed in a float mount arrangement within a larger aperture of a first panel by a snap ring cooperable with a rearward bushing to trap an inwardly directed flange of the aperture. The plug connector is secured by a snap ring within a snugly fitting shroud member firmly affixed within an aperture of the second panel, so that the plug connector is secured against movement radially and axially. The shroud extends forwardly from the panel and beyond all other portions of the first connector, for its leading end to engage a tapered outer bearing surface of the leading end of the outer conductor of the second connector and causes the second connector to move incrementally sideways to become perfectly aligned with the first connector as the panels continue to be moved together, achieving radial alignment. For precise axial positioning, the jack connector similarly to U.S. Pat. No. 4,697,859 is forwardly biased in order to be moved rearwardly upon abutting engagement with the plug connector in the final stages of panel movement.

It is desired to provide a coaxial connector that achieves minimized impedance mismatch where one of the halves of the connector is electrically connected to a stripline circuit board rearwardly of its panel, and the other connector may be electrically connected to a microstrip circuit board.

It is further desired to provide a coaxial connector for a stripline circuit board, that is float-mounted in a panel to mate with a fixedly mounted complementary connector.

It is also desired to provide a float-mounted coaxial connector that is of limited axial dimension to define a low profile.

SUMMARY OF THE INVENTION

In the present invention, a first connector mounted within an aperture of its panel is adapted to adjust its position both axially and transversely upon mating with a second connector that is firmly affixed within the aperture of its panel. The first connector includes an outer shell firmly affixed within the panel aperture, and further includes a subassembly float mounted for both axial and radial movement within the outer shell and containing the inner conductor within a dielectric sleeve affixed and centered within an intermediate housing. The intermediate housing includes a reduced diameter rearward section to the end of which is firmly affixed an outwardly flanged bushing that is disposed rearwardly of an inwardly directed flange of the outer shell.

Between the bushing and the larger diameter forward housing portion is disposed an annular spring such as a curved spring washer around the rearward section and having a minimal axial dimension. The trailing edge of the curved spring washer is disposed adjacent the inwardly directed flange of the outer shell, while its leading edge is disposed adjacent the rearwardly facing shoulder defined by the larger diameter forward housing portion. Inner and outer diameters of the washer are selected to provide a clearance to permit radial float of the subassembly with respect to the outer shell. Preferably, a large aperture through the curved spring washer permits the rearward section of the intermediate housing to move transversely within the large aperture, while the washer maintains compression against the shoulder. Thus the washer permits the intermediate housing to be moved incrementally axially rearwardly and also transversely within limited ranges and compensating for tolerance variations in the spacing between the panels being brought together, and also compensating for offsets between the centerlines of the first and second connectors.

In one particularly useful application of the present invention, the inner conductor of the first connector is electrically connected to a stripline circuit of a circuit board rearwardly of the panel in a manner permitting incremental movement with respect to the circuit board while assuredly maintaining the electrical connection, while the outer conductor is in electrical connection with a ground layer of the circuit board. A resilient contact member is firmly affixed to the stripline circuit, and a contact section of the inner conductor of the floating subassembly of the first connector extends beyond the panel to which the first connector is mounted to matingly engage a leading end of the resilient contact member under compression in a manner that permits the contact section to move incrementally transversely with respect to the resilient contact member while maintaining an assured electrical engagement.

The resilient contact member may be a bellows spring contact with a transverse mating face having a pin-receiving recess thereinto, and the contact section of the inner conductor of the first connector concludes in a pin shape complementary to the pin-receiving recess. The bellows contact permits the mating face to be moved transversely by the contact section of the inner conductor, when the first connector responds to the second connector during mating by adjusting its position transversely. The bellows contact also permits incremental axial movement of the contact section towards the circuit board.

In one embodiment of the present invention useful with a stripline circuit board, the intermediate housing of the subassembly includes a rearwardly extending contact section in electrical engagement with a ground plane of the circuit board to define a direct grounding circuit therewith, preferably comprising an array of spring arms biased against a plated sidewall of an aperture into the circuit board that is joined to the ground plane.

It is an objective of the present invention to provide a mating coaxial connector assembly for panel-mounting that compensates for variations in panel-to-panel spacing and also offsets in the centerline alignment of the mating coaxial connectors, while maintaining an assured electrical connection to circuits of the electronics within the apparatus to which the panels are secured, by minimizing any stress to the terminations to the circuits by the inner conductors of the mating connectors.

It is also an objective of the present invention to provide a float-mounted coaxial connector that has a minimized axial dimension between the mating face and the contact engagement with the circuits of the electronics within the apparatus, permitting a substantial portion of the connector to be disposed within the thickness of a thin panel.

It is further an objective to provide a float-mounted coaxial connector especially useful with a stripline circuit board within the apparatus having a resilient contact joining the inner conductor of the connector with the signal circuit of the board.

It is even further an objective to provide such a float-mounted coaxial connector adapted to define a direct ground circuit with a ground plane of the stripline circuit board.

Embodiments of the present invention will now be described by way of example with reference to the accompanying drawings.

DETAILED DESCRIPTION OF THE PREFERRED EMBODIMENTS

Figure 1:
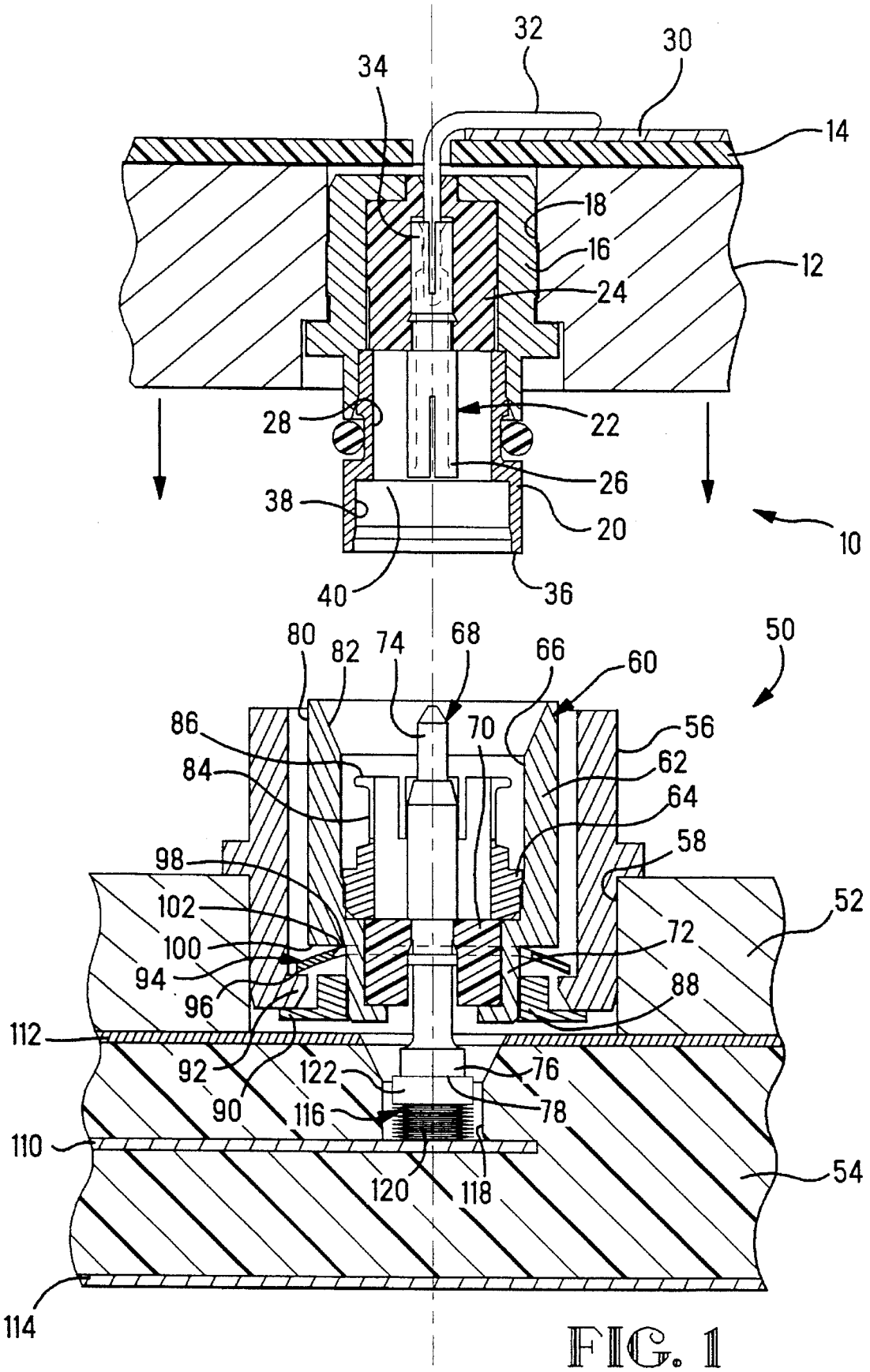
FIG. 1 is a longitudinal section view of the connectors affixed to respective panels and about to become mated, one of the connectors being firmly affixed to its panel and the other affixed in a manner permitting incremental axial and transverse movement, and with the inner conductors electrically connected to circuits of respective circuit boards.

Referring to FIG. 1, first coaxial connector 50 is affixed to a first panel 52 of an apparatus (not shown) and is electrically connected to a circuit board 54 rearwardly of panel 52. First connector 50 includes an outer shell 56 firmly affixed within aperture 58 of panel 52, and a subassembly 60 mounted within outer shell 56. Subassembly 60 includes an intermediate housing 62 defining an outer conductor of the coaxial connector, a conductive insert 64 mounted within the mating cavity 66 of intermediate housing 62, and a contact member 68 mounted within a dielectric sleeve 70 affixed within rearward section 72 of intermediate housing 62 so that contact member 68 is precisely coaxially disposed within intermediate housing 62 and forward pin contact section 74 thereof is coaxially disposed within conductive insert 64. Rearward contact section 76 extends to an end 78 rearwardly beyond rearward ends of the intermediate housing 62 and outer shell 56 and beyond first panel 52 to establish an electrical connection to a signal circuit of circuit board 54.

Circuit board 54 is shown to be a stripline circuit board in which a signal circuit 110 is embedded centrally within insulative material of the board, and is shielded between ground planes 112,114 defined on the major surfaces of the board. A resilient contact member 116 is shown disposed within aperture 118 electrically connected to signal circuit 110 of circuit board 54 and includes a resilient section 120 adjacent circuit board 52 and a forward contact section 122 matable with the inner conductor of first coaxial connector 50 at end 78 of rearward contact section 76.

Second coaxial connector 10 is affixed to a second panel 12 of an apparatus (not shown) and is shown electrically connected to a microstrip circuit board 14 rearwardly of second panel 12. Outer conductor 16 is firmly affixed within aperture 18 of second panel 12, and includes a forward section 20 extending beyond second panel 12 to be received within forward section 80 of intermediate housing 62 of first connector 50 during mating. Coaxially within outer conductor 16 is disposed contact member 22 within a dielectric sleeve 24 and defining the inner conductor, having a forward contact section 26 extending forwardly within large cavity 28 of outer conductor 16. Contact member 22 is shown electrically connected to signal circuit 30 of circuit board 14 by a right angle pin 32 soldered to circuit 30 and mated to a rear socket section 34 of contact member 22. The electrical connection of the outer conductor is established through conductive panel 12 serving as a ground plane for the microstrip and which is separated from the signal circuit 30 by a layer of dielectric material.

Forward contact section 26 of contact member 22 of second connector 10 is disclosed to be a socket section matable with forward pin contact section 74 of contact member 68 of first connector 50 upon mating. Forward section 20 of outer conductor 16 is adapted to be received into large cavity 66 of large diameter forward section 80 of intermediate housing 62 of first connector 50, with leading end 36 initially engageable with tapered surface 82 defining a leadin to large cavity 66 to facilitate alignment of the mating connectors. During mating, spring arms 84 of conductive insert 64 engage and bear against inner surface 38 of forward section 20 of outer conductor 16 of second connector 10 to establish an assured electrical engagement between the outer conductors of the first and second coaxial connectors, at a selected axial location relative to the contact engagement location of the inner conductors thereof for optimized coaxial connection performance. Forward section 20 may continue to move axially forwardly until leading ends 86 of spring arms 84 abut forwardly facing surface 40 of forward section 20 of outer conductor 16.

In further reference to second coaxial connector 50, a bushing 88 is secured around the rearward end of rearward section 72 of intermediate housing 62 and includes a flange 90 extending radially outwardly therefrom disposed rearwardly of an inwardly directed flange 92 of outer shell 56. A cylindrically curved washer 94 is secured around the rearward section 72 of intermediate housing 62, and trailing end 96 thereof together with flange 90 of bushing 88 mounts subassembly 60 within outer shell 56 by engaging flange 92 of outer shell 56. Leading end 98 abuts rearwardly facing shoulder 100 defined by large diameter forward section 80 of intermediate housing 62, and the utilization of curved washer 94 permits incremental axial movement of subassembly 60 with respect to outer shell 56 and hence with first panel 52. Curved washer 94 further includes a large aperture 102 around rearward section 72 of intermediate housing 62 and permits incremental radial movement of subassembly 60 with respect to outer shell 56.

Figure 2:
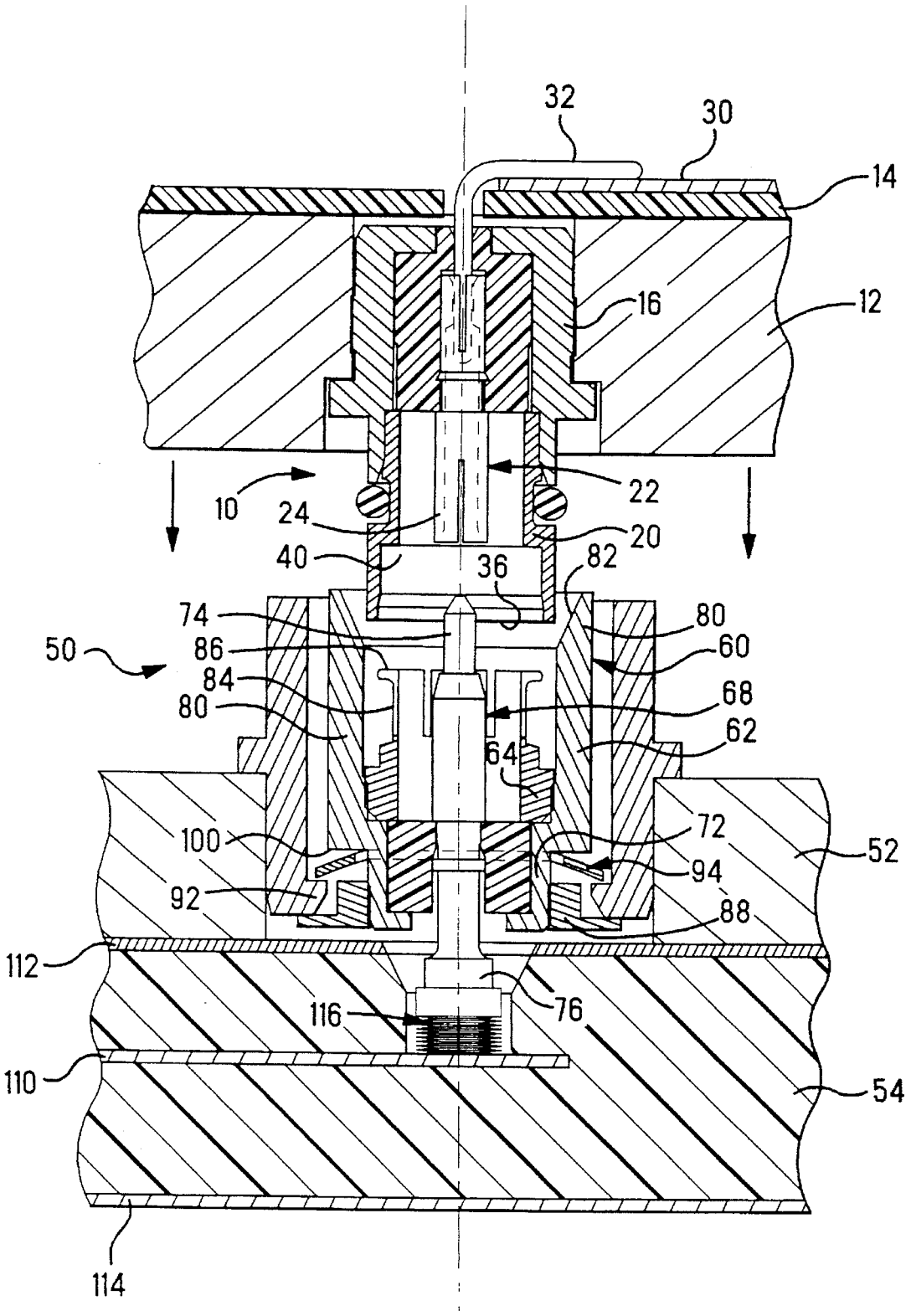
FIG. 2 is similar to FIG. 1 with the connectors about to become initially engaged during mating where the centerlines are in alignment.
Figure 3:
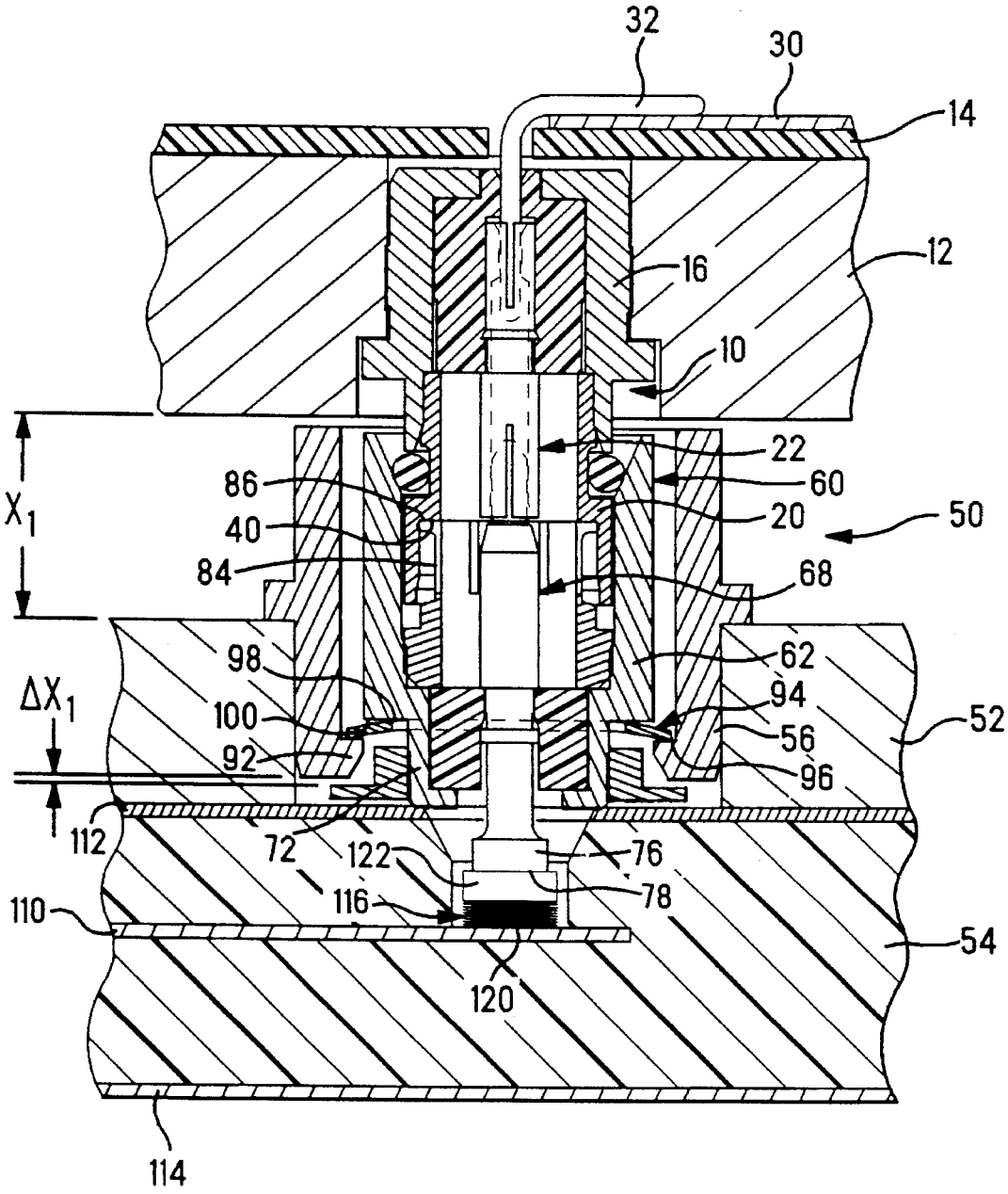
FIG. 3 is similar to FIG. 2 with the connectors fully mated and the panels spaced apart the minimum distance allowed by the connectors.

In FIG. 2 panel 12 is being moved toward panel 52, to eventually result in the mating of connectors 10,50. Connector 10 is shown as having its centerline coincident with that of connector 50 in the ideal or nominal situation. In FIG. 3 panels 12,52 have been brought together to a final position until spaced apart a distance $X_1$, their closest permissible distance. Connectors 10,50 have become mated, with subassembly 60 of connector 50 being urged rearwardly a distance of $\Delta X_1$ by reason of connector 10 having abutted subassembly 60 before panel 10 has been moved to its closest permitted position. Subassembly 60 has therefore been urged rearwardly a distance of $\Delta X_1$ so that rearward contact section 76 compresses resilient contact 116 axially to accommodate the new axial position of end 78 of rearward contact section 68.

Figure 6:
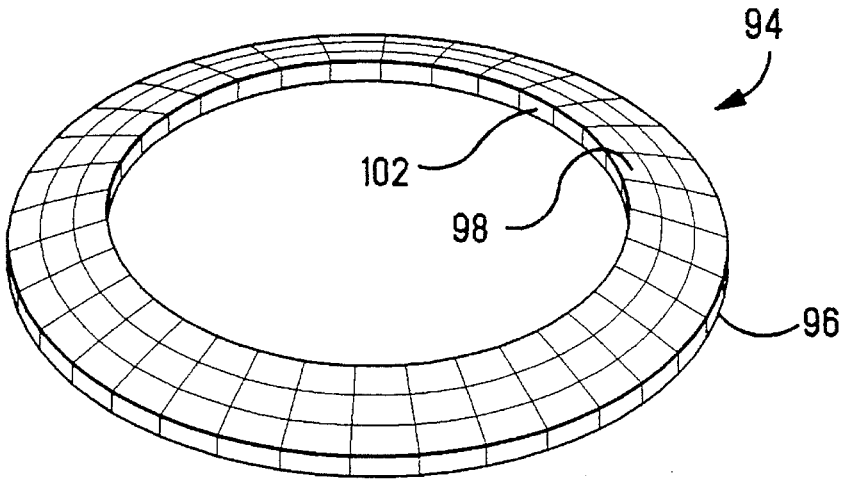
FIG. 6 is an isometric view of a curved spring washer mounted within the float mounted connector.

Curved washer 94 is compressible between leading end 98 and trailing end 96, generating spring bias on subassembly 60 urging it toward second connector 10 upon mating. The dimensions of curved washer 94 and of the distance between inwardly direct flange 92 of outer shell 56 and the rearwardly facing shoulder 100 of intermediate housing 62 are such that curved washer 94 continuously provides some bias between flange 92 and subassembly 60 prior to connector mating. Curved washer 94 provides the advantage of a biasing means necessary for use in panel-mounted coaxial connectors without the axial length of the conventional compression spring. Curved washer 94 is shown in greater detail in FIG. 6, and may be an AMSCO cylindrically curved washer sold by Accurate Screw Machine Co. of Fairfield, N.J.

Figure 4:
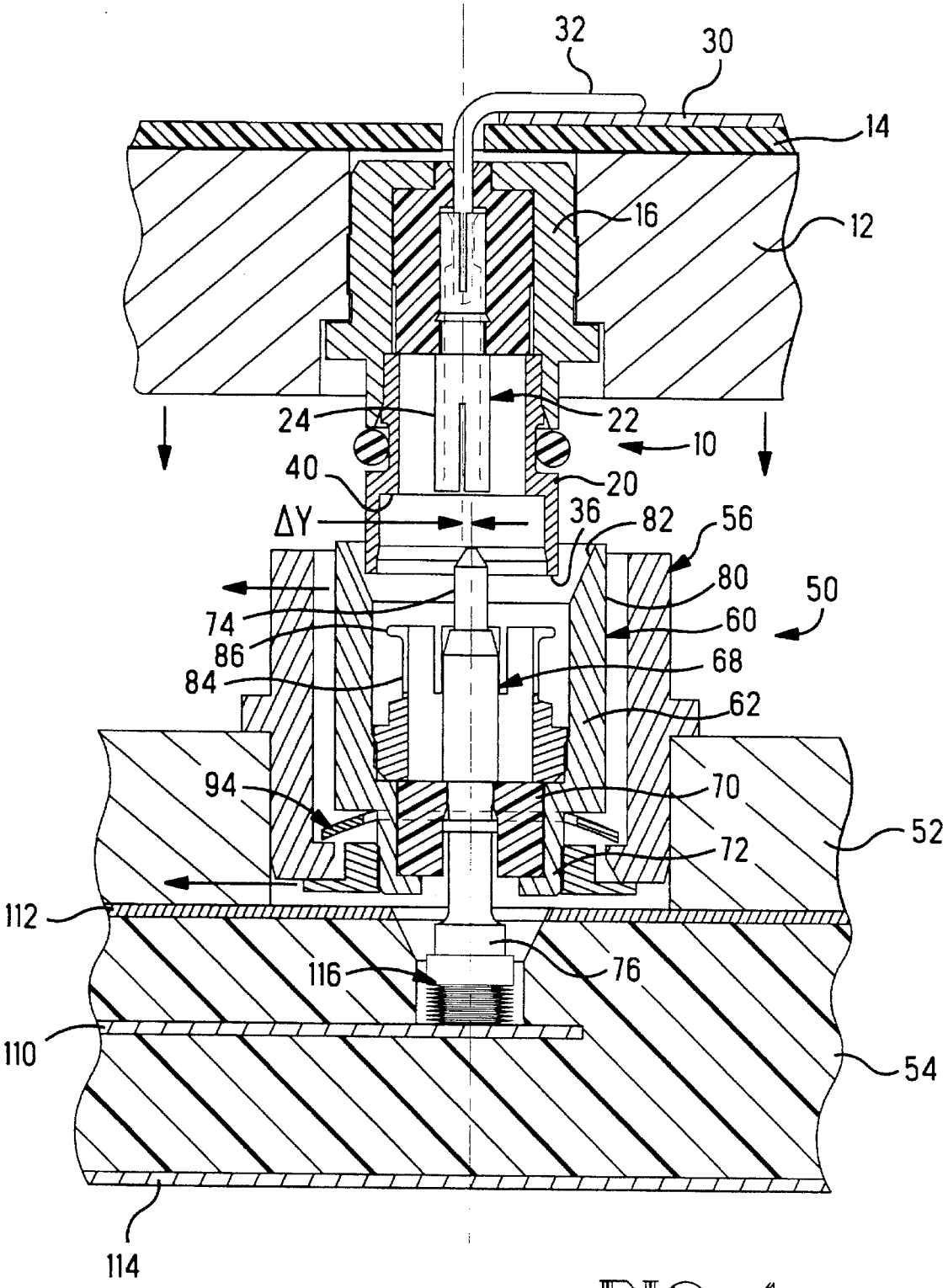
FIG. 4 is a longitudinal section view similar to FIG. 2 with the centerlines offset.
Figure 5:
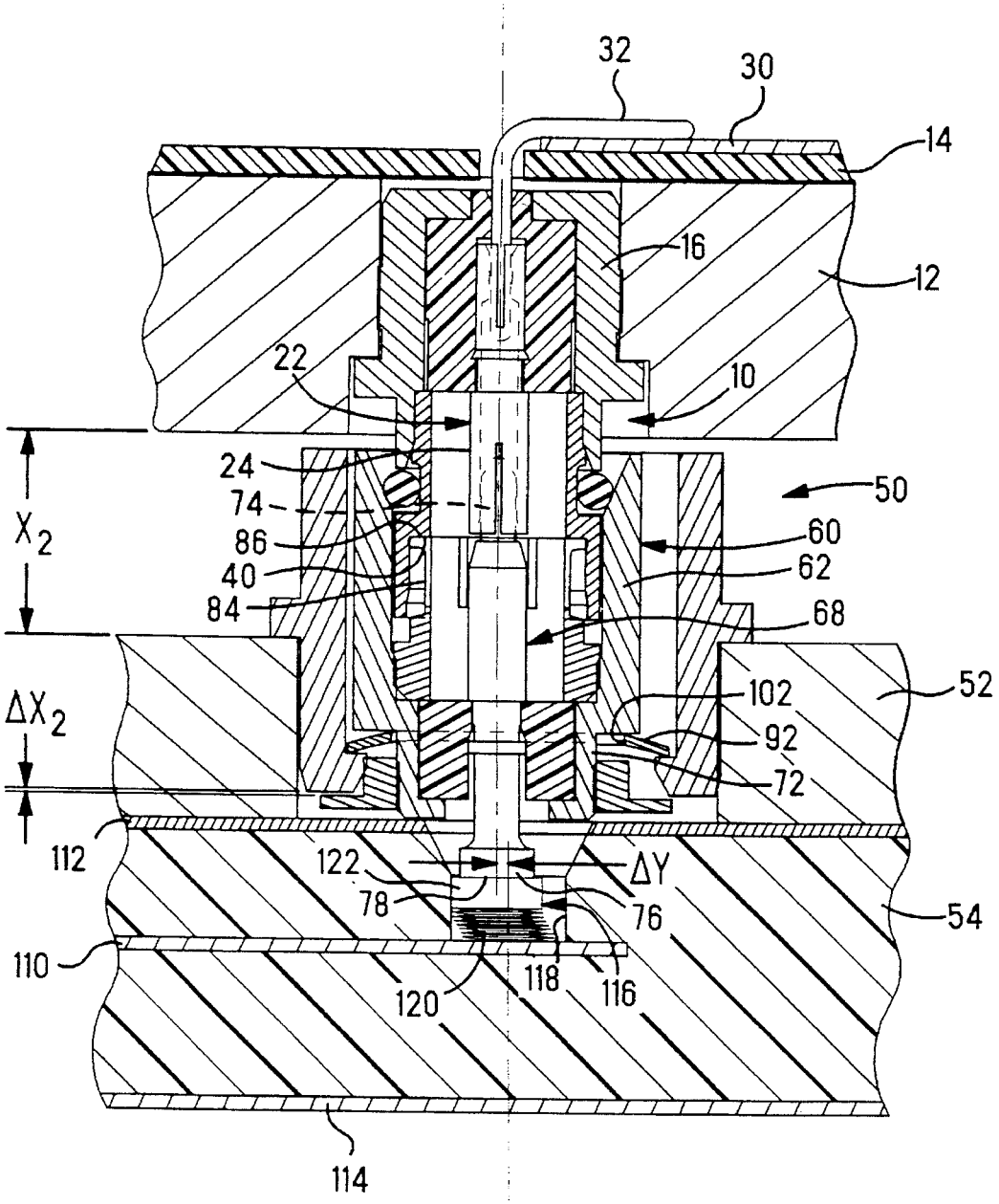
FIG. 5 is similar to FIG. 4 with the connectors fully mated and illustrating one of the connectors having adjusted its position transversely to become aligned with the other connector.

With respect to FIGS. 4 and 5, connector 10 is being mated with connector 50 when its centerline is offset a lateral distance $\Delta Y$. In FIG. 4, leading edge 36 of connector 10 is about to engage the tapered leadin 82 of intermediate housing 62, the leading portion of connector 50. In FIG. 5 connectors 10,50 have become mated. As in FIG. 3, leading ends 86 of spring arms 84 abut forwardly facing surface 40 of outer conductor 16 at the fully mated condition; however, FIG. 5 illustrates a panel-to-panel distance of $X_2$ that is shown to be greater than $X_1$ of FIG. 3 such that subassembly 60 is urged rearwardly a distance $\Delta X_2$ less than $\Delta X_1$ and resulting in less deflection or compression of curved washer 94, illustrating its forgiveness of incremental differences in the panel-to-panel distance.

Also in FIG. 5, subassembly 60 of connector 50 has been urged laterally an equivalent distance $\Delta Y$ to align the centerlines of connector 50 with that of connector 10 when leading edge 36 of forward section 20 of outer conductor 16 of connector 10 engages and bears against tapered leadin 82 of subassembly 60 extending to large cavity 66 and resulting in precise alignment of contact member 68 with contact member 22 of connector 10 just prior to full connector mating. Lateral translation of contact member 68 as carried by subassembly 60 results in movement equalling distance $\Delta Y$ of rearward contact section 76 with respect to the centerline of resilient contact 116, as well as an additional incremental axial compression of resilient contact 116 thereby in an amount less than that occurring in FIG. 3.

Figure 7:
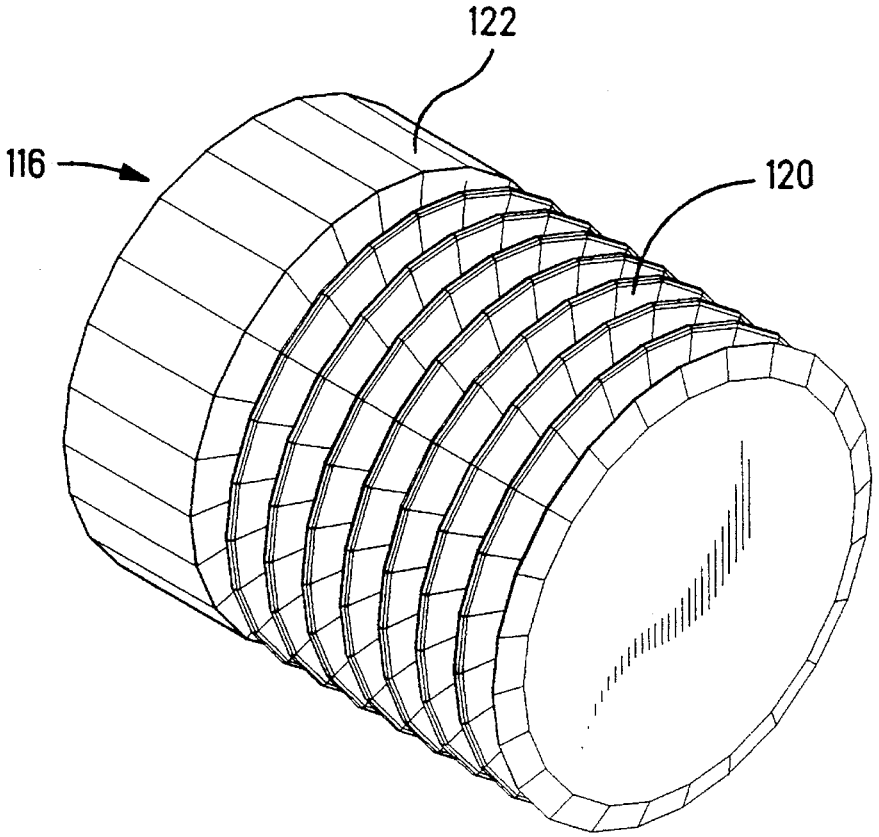
FIG. 7 is an isometric view of a bellows contact spring member utilized to define the electrical connection of the inner conductor of the float mounted connector to the circuit of the circuit board.

A preferred resilient contact 116 is shown in FIG. 7 to be a bellows contact spring such as Part No. 2156 sold by Servometer of Cedar Grove, N.J. Resilient section 120 is a bellows arrangement and is disposed adjacent the signal circuit of the stripline circuit board and continuously under compression thereagainst by engagement of the end of the rearward contact section of the contact member. Thus the electrical connection between the contact member and the signal circuit need not involve a solder joint; such a solder joint could be damaged when subjected to stresses due to incremental movement of the subassembly of the float-mounted coaxial connector. Resilient section 120 of the bellows contact spring has the property of permitting forward contact section 122 to be moved laterally by reason of the pressure engagement with the rearward contact section of the contact member, while still maintaining an assured pressure connection with the signal circuit.

Figure 8:
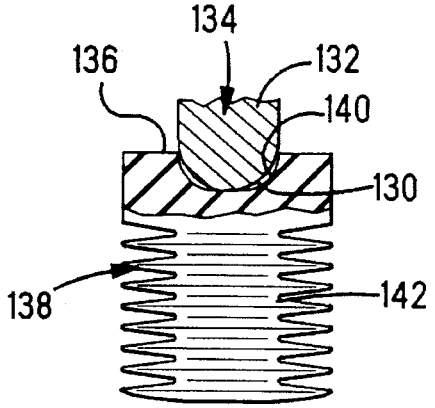
FIGS. 8 TO 13 are enlarged section views of various alternate embodiments the electrical connection interface of the inner conductor of the float mounted connector with a bellows contact spring member like that shown in FIG. 7, with FIGS. 8 and 9 illustrating the radial offset compensation capability of the bellows spring member.
Figure 9:
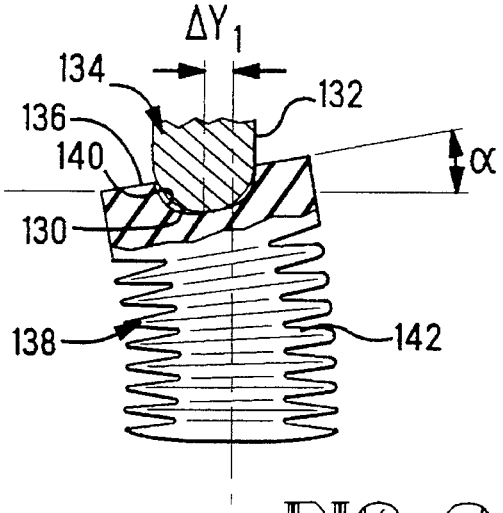

Referring now to FIGS. 8 and 9, a diagrammatic illustration exhibits the engagement of end 130 of rearward contact section 132 of contact member 134, with forward contact section 136 of one embodiment of a bellows-type resilient contact spring 138. Contact spring 138 is shown to have a concave pin-receiving cavity 140 generally complementary with a convex end 130 of contact member 134, and to have a bellows section 142. In FIG. 8 the centerlines of contact member 134 and contact spring 138 are axially and angularly aligned. In FIG. 9 the centerline of contact member 134 is shown to be laterally offset from the centerline of contact spring 138 an incremental distance $\Delta X_1$. Since forward contact section 136 has been urged laterally incremental distance $\Delta X_1$, contact spring 138 permits forward contact section 136 to be incrementally rotated an angular distance $\alpha$ by reason of flexure of bellows section 142, with an assured electrical connection maintained between contact member 134 and contact spring 138.

Figure 10:
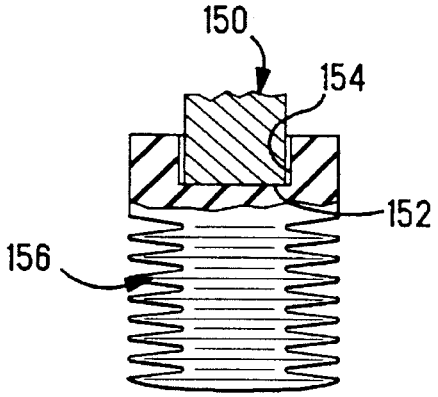
Figure 11:
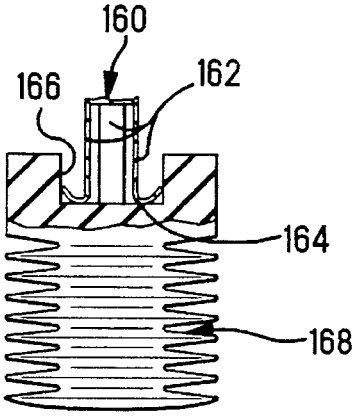
Figure 12:
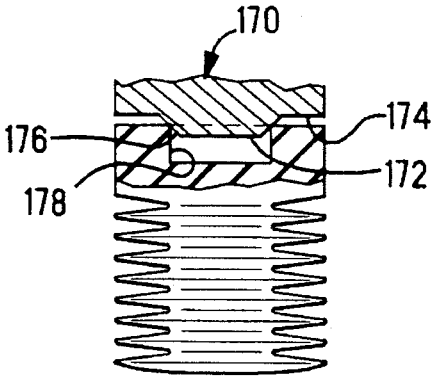
Figure 13:
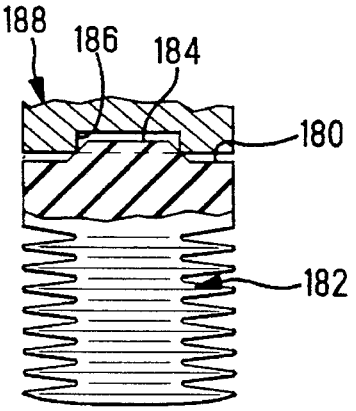

FIGS. 10 to 13 illustrate various alternative designs of the contact interface between embodiments of contact members and contact springs. In FIG. 10, contact member 150 defines a blunt end 152, disposed within a cylindrical pin-receiving recess 154 of contact spring 156. In FIG. 11, contact member 160 defines an array of tines 162 having free ends 164 bent first radially outward and then rearwardly, preferably defining an outer diameter just greater than the inner diameter of cylindrical pin-receiving recess 166 of contact spring 168 to assure spring biased engagement with the sidewalls of recess 166 at a plurality of locations therearound. In FIG. 12, contact member 170 defines a low-height frustoconical embossment 172 on end 174 having a tapered peripheral edge surface 176 dimensioned to engage the periphery of cylindrical pin-receiving recess 178 of the contact spring. In FIG. 13, forward end 180 of contact spring 182 defines a frustoconical embossment 184 adapted to engage the periphery of a cylindrical recess 186 defined into the rearward end of contact member 188. It can be understood that the embodiments of engagement interfaces in FIGS. 11 to 13, as well as that of FIG. 8, provide a plurality of locations of physical engagement between each contact member and the associated contact spring even when the centerlines thereof are at an incremental angle with respect to each other, as depicted in FIG. 9.

Curved washer 94 is selected to have a large inner diameter with respect to the outer diameter of the rearward section 90 of intermediate housing 62. The radial clearance thus resulting provides the additional advantage of permitting transverse movement of the intermediate housing with respect to outer shell 56. Thus use of curved washer 94 of the present invention improves the responsiveness of the float-mounted coaxial connector to a range of offset positions of the fixed mating connector, as well as a range of axial positions thereof, while providing effective impedance control.

Figure 14:
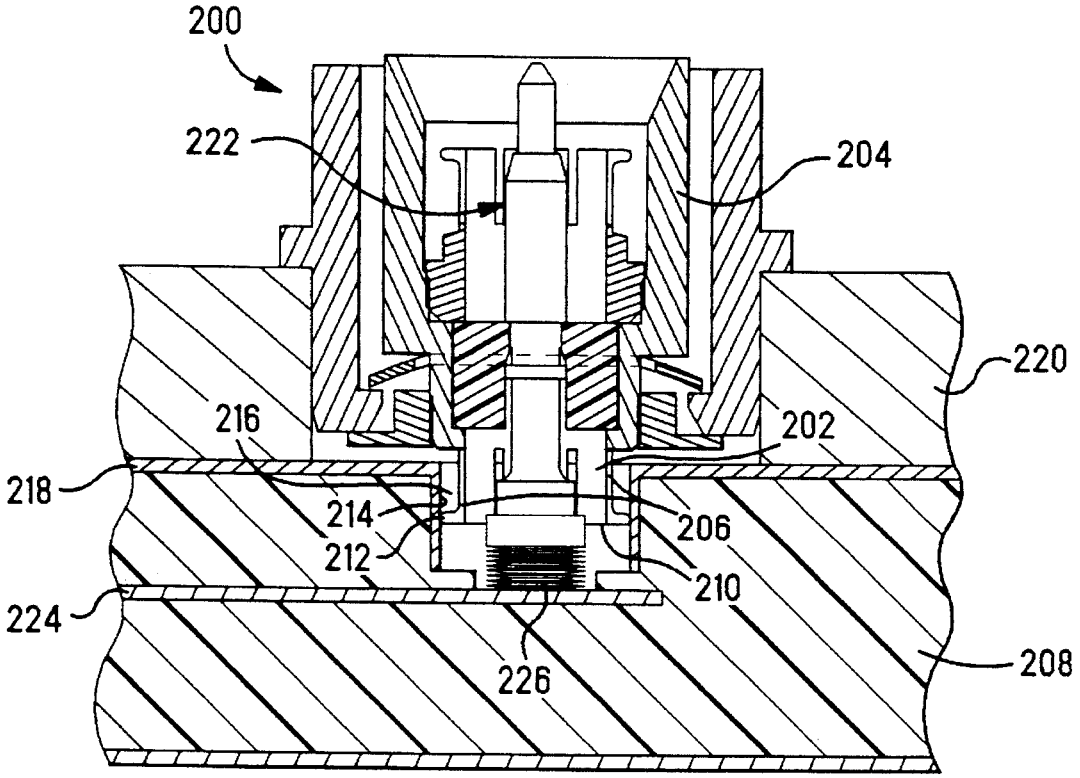
FIG. 14 is another embodiment wherein the outer conductor includes a rearwardly extending contact section in engagement with the ground plane of the stripline circuit board and surrounding the inner conductor engagement with the resilient contact of the circuit board.

FIG. 14 illustrates a second embodiment of coaxial connector 200 similar in most respects to connector 50 of FIGS. 1 to 5 and matable with connector 10 thereof. Connector 200 includes a rearward outer contact section 202 defined on intermediate housing 204. Outer contact section 202 comprises an array of spring contact arms 206 extending toward stripline circuit board 208 and concluding in free ends 210. Radially outward embossments 212 on free ends 210 are in continuous spring biased grounding engagement with conductive sidewall 214 of aperture 216 electrically connected to ground plane 218 after assembly of connector 200 to panel 220. Contact member 222 is in continuous electrical engagement with signal circuit 224 of circuit board 208 utilizing a resilient contact 226, as in FIGS. 1 to 5. Both the signal circuit and ground circuit between connector 200 and stripline circuit board 208 are understandable to be tolerant of incremental shifts of position both axially and laterally upon mating of float-mounted coaxial connector 200 with a fixedly mounted mating coaxial connector.

Variations and modifications may be made to the specific embodiment disclosed herein that are within the spirit of the invention and the scope of the claims.

We claim:

1. An improved coaxial connector assembly mountable in a panel aperture and matable with a complementary panel-mounted coaxial connector, comprising:

an outer conductive shell fixedly secured within an aperture through a panel extending from a first surface thereof to an opposed second surface, a coaxial connector subassembly secured within said outer conductive shell and secured against forward axial movement with respect thereto at a rearward section of a conductive intermediate housing at a rearward end of said outer shell, said subassembly including a contact member defining an inner conductor and secured within a dielectric sleeve to be centered with respect to an inner surface of said intermediate housing, with a rearward contact section of said contact member of said subassembly electrically connected to a respective conductor rearwardly of said panel for signal transmission;

said contact member including a forward contact section exposed within a large cavity of a forward section of said intermediate housing for mating with a complementary contact member of a mating coaxial connector, with said forward section of said intermediate housing adapted for mating with a complementary forward section of an outer conductive housing of said mating coaxial connector;

the improvement comprising:

said rearward section of said intermediate housing being smaller in diameter than said forward section to define a rearwardly facing abutment surface, said outer shell and said intermediate housing of said subassembly being dimensioned to permit incremental axial movement and incremental radial movement of said subassembly within said outer shell and including a conductive annular spring disposed around said rearward section of said intermediate housing and rearwardly of said abutment surface, and said annular spring being disposed forwardly of a reduced diameter radially inward flange of said outer shell, all such that a leading end of said annular spring is at least abuttable with and compressible between said abutment surface and said outer shell flange to permit incremental axial movement of said subassembly with respect to said outer shell upon connector mating when urged rearwardly by engagement with said mating coaxial connector; and said annular spring having inner and outer diameters selected to define a clearance between at least one of said rearward section of said intermediate housing and an inwardly facing surface of said outer shell permitting incremental lateral movement of said subassembly within said outer shell upon connector mating when urged laterally by engagement with said mating coaxial connector, whereby said subassembly is float-mounted within said outer shell to accommodate a range of mated positions axially and laterally with respect to said mating coaxial connector.

2. The improved coaxial connector assembly of claim 1 wherein said annular spring is compressed upon assembly of said subassembly within said outer shell between said abutment surface and said outer shell flange.

3. The improved coaxial connector assembly of claim 1 wherein said annular spring is a curved cylindrical washer of minimal axial dimension resulting in a reduced overall axial dimension of said coaxial connector.

4. An improved coaxial connector assembly mountable in a panel aperture in electrical engagement with a stripline circuit board and matable with a complementary panel-mounted coaxial connector, comprising:

an outer conductive shell fixedly secured within an aperture through a panel extending from a first surface thereof to an opposed second surface, a coaxial connector subassembly secured within said outer conductive shell and secured against forward axial movement with respect thereto at a rearward section of a conductive intermediate housing at a rearward end of said outer shell, said subassembly including a contact member defining an inner conductor and secured within a dielectric sleeve to be centered with respect to an inner surface of said intermediate housing, and a resilient contact associated with said stripline circuit board and in electrical engagement with a signal circuit thereof and with a rearward contact section of said contact member of said subassembly while isolated from ground planes of said stripline circuit board, said panel, said intermediate housing and said outer shell;

said contact member including a forward contact section exposed within a large cavity of a forward section of said intermediate housing for mating with a complementary contact member of a mating coaxial connector, with said forward section of said intermediate housing adapted for mating with a complementary forward section of an outer conductive housing of said mating coaxial connector;

the improvement comprising:

said rearward section of said intermediate housing being smaller in diameter than said forward section to define a rearwardly facing abutment surface, said outer shell and said intermediate housing of said subassembly being dimensioned to permit incremental axial movement and incremental radial movement of said subassembly within said outer shell and including a conductive annular spring disposed around said rearward section of said intermediate housing and rearwardly of said abutment surface, and said annular spring being disposed forwardly of a reduced diameter radially inward flange of said outer shell, all such that a leading end of said annular spring is at least abuttable with and compressible between said abutment surface and said outer shell flange to permit incremental axial movement of said subassembly with respect to said outer shell upon connector mating when urged rearwardly by engagement with said mating coaxial connector; and said annular spring having inner and outer diameters selected to define a clearance between at least one of said rearward section of said intermediate housing and an inwardly facing surface of said outer shell permitting incremental lateral movement of said subassembly within said outer shell upon connector mating when urged laterally by engagement with said mating coaxial connector, whereby said subassembly is float-mounted within said outer shell to accommodate a range of mated positions axially and laterally with respect to said mating coaxial connector.

5. The improved coaxial connector assembly of claim 4 wherein said annular spring is compressed upon assembly of said subassembly within said outer shell between said abutment surface and said outer shell flange.

6. The improved coaxial connector assembly of claim 4 wherein said annular spring is a curved cylindrical washer of minimal axial dimension resulting in a reduced overall axial dimension of said coaxial connector.

7. The improved coaxial connector assembly of claim 4 wherein said intermediate housing includes a rearwardly extending contact section adapted to engage plating material of a said ground plane of said stripline circuit board to complete a direct ground circuit between said intermediate housing and said ground plane.

8. The improved coaxial connector assembly of claim 7 wherein said rearwardly extending contact section comprises an array of spring arms extending into an aperture of said stripline circuit board surrounding said resilient contact, said spring arms spaced radially from said rearward contact section and said resilient contact and adapted to be in continuous electrical engagement with conductive material on sidewalls of said aperture, whereby said ground circuit is maintained during incremental axial and lateral movement of said intermediate housing during mating with said mating coaxial connector.

* * * * *